US010947758B2

(12) United States Patent
Ferreira

(10) Patent No.: US 10,947,758 B2
(45) Date of Patent: Mar. 16, 2021

(54) PADLOCK

(71) Applicant: PADO S/A INDUSTRIAL COMERCIAL E IMPORTADORA, Sao Paulo (BR)

(72) Inventor: Rafael Francisco Ferreira, Sao Paulo (BR)

(73) Assignee: PADO S/A INDUSTRIAL COMERCIAL E IMPORTADORA, Sao Paulo (BR)

( * ) Notice: Subject to any disclaimer, the term of this patent is extended or adjusted under 35 U.S.C. 154(b) by 0 days.

(21) Appl. No.: 15/733,147

(22) PCT Filed: Nov. 22, 2018

(86) PCT No.: PCT/BR2018/050430

§ 371 (c)(1),
(2) Date: May 28, 2020

(87) PCT Pub. No.: WO2019/104403

PCT Pub. Date: Jun. 6, 2019

(65) Prior Publication Data

US 2020/0370342 A1 Nov. 26, 2020

(30) Foreign Application Priority Data

Nov. 29, 2017 (BR) ..... 1020170256472

(51) Int. Cl.
*E05B 67/38* (2006.01)
*E05B 67/24* (2006.01)

(52) U.S. Cl.
CPC ..... *E05B 67/38* (2013.01); *E05B 67/24* (2013.01); *E05Y 2800/674* (2013.01)

(58) Field of Classification Search
CPC ..... E05B 67/38; E05B 67/24; E05B 67/22; E05B 2067/066; E05B 67/02; E05Y 2800/674

(Continued)

(56) References Cited

U.S. PATENT DOCUMENTS 2,433,114 A * 12/1947 Gray ..... E05B 67/24 70/367
3,008,318 A * 11/1961 Gutman ..... E05B 67/24 70/38 A (Continued)

OTHER PUBLICATIONS

English Translation of International Patent Application No. PCT/BR2018/050430 International Search Report dated Nov. 30, 2018, 2 pages.

*Primary Examiner* — Lloyd A Gall
(74) *Attorney, Agent, or Firm* — Leber IP Law; Celia H. Leber

(57) ABSTRACT

The present invention relates to a padlock having a metal U-shaped rod seated in an outer polymer body. The padlock has a one-piece actuating device that is formed by a base that is operatively associated with the core of the cylinder unit, an elongate body portion that is positioned above the base and has end portions designed to be seated in corresponding recesses of the rod, and a stop portion that projects laterally from the elongate body portion. Rotating the core of the cylinder unit to open the padlock causes the rotation of the base of the actuating device, and consequently the rotation of the elongate body, causing the end portions of the elongate body to come out of the recesses in the rod.

7 Claims, 5 Drawing Sheets

(58) Field of Classification Search
USPC ..... 70/21, 25, 38 R, 38 A, 38 B, 38 C, 39, 70/52, 379 R, 379 A, 380
See application file for complete search history.

(56) References Cited

U.S. PATENT DOCUMENTS

| | | | | | |
|---|---|---|---|---|---|
| 3,626,729 | A | * | 12/1971 | Fane et al. | E05B 67/24 70/18 |
| 3,653,235 | A | * | 4/1972 | Fane | E05B 67/24 70/38 A |
| 3,768,137 | A | * | 10/1973 | Russell | E05B 67/24 29/238 |
| 3,882,699 | A | | 5/1975 | Flack et al. | |
| 4,112,715 | A | * | 9/1978 | Uyeda | E05B 67/24 70/38 A |
| 5,186,029 | A | * | 2/1993 | Myers | E05B 67/24 70/371 |
| 5,819,560 | A | | 10/1998 | Grahovec et al. | |
| 7,278,283 | B2 | | 10/2007 | Meckbach | |
| 7,966,849 | B2 | * | 6/2011 | Wu | E05B 67/24 70/38 R |

* cited by examiner 2a 5

PADLOCK

RELATED APPLICATIONS

This application is a national phase entry of International Patent Application No. PCT/BR2018/050430, filed Nov. 22, 2018, which claims priority from Brazilian Patent Application No. 1020170256472, filed Nov. 29, 2017, the entire disclosures of which are incorporated herein by reference.

FIELD OF THE INVENTION

The present invention relates to a padlock and, more specifically, to a padlock of the type comprising a metal rod or a thermofixed polymer rod, U-shaped seated in a polymeric outer body.

The padlock of the present invention can, for example, be used in the locking of industrial electrical panels for maintenance, cleaning or control, ensuring the security of who performs maintenance, as, for example, for the requirement of the NR10 standard for Safety in plants and services in electricity.

BACKGROUND OF THE INVENTION

Different types of locking are known in the state of the art for a rod of padlock, such as spring-loaded locking bars or mechanical actuators, cam-driven locking rollers and locking balls driven by rotating devices. These locking means are generally opened and closed by the action of a locking cylinder activated by a key or secret.

U.S. Pat. No. 3,882,699, for example, shows an attack resistant padlock comprising a body in which a U-shaped rod is seated. The rod comprises two recesses, adapted to receive latches. The latches are longitudinally movable between a retracted position, in which the rod can be moved to open the padlock, and an extended position, in which the ends of the latches are seated in the recesses to lock the rod for closing the padlock.

U.S. Pat. No. 5,819,560 shows a padlock having a light split body housing a U-shaped rod and a locking mechanism formed by locking balls and a rotating latch. Thus, the rod is locked by the locking balls, which, in turn, are moved by the rotating latch. Similar to bar locking, the rod has recesses that receive the balls when locking.

U.S. Pat. No. 7,278,283 shows a padlock having an outer body part and an inner body part. The body parts are configured to house the U-shaped rod and a locking mechanism of the type formed by locking balls and a rotary drive.

U-shaped rods in the state-of-the-art padlocks generally comprise a longer leg that remains seated in the body even when the rod is unlocked for opening the padlock. Thus, in the known solutions, the padlock further comprises a means for retaining the longest leg in the body of the padlock.

The provision of different components of the locking mechanism and the rod movement mechanism enables manufacturing complexity, since the parts must interact with each other and with the padlock body in a safe and flawless manner.

Thus, the complexity of design and manufacturing leads to increased costs and an increased risk of manufacturing failures.

OBJECTS OF THE INVENTION

Thus, it is an object of the present invention to provide a U-shaped padlock with simplified design.

It is another object of the present invention to provide a U-shaped padlock that can be assembled through a simple and secure process.

Another object of the present invention is to provide a U-shaped padlock that can be sealed by ultrasound welding.

It is yet another object of the present invention to provide a padlock with a U-shaped rod that has an ergonomic handle.

It is another object of the present invention to provide a padlock with a U-shaped rod that does not propagate flame.

It is yet another object of the present invention to provide a U-shaped padlock that has an ergonomic handle.

It is yet another object of the present invention to provide a padlock that allows simpler and more economical manufacturing.

BRIEF DESCRIPTION OF THE INVENTION

The objects of the present invention, referred to above, are achieved by means of a padlock of the type comprising a U-shaped rod seated in a body, the rod being unlocked by turning a core of the cylinder unit. The padlock comprises a one-piece actuating device that is formed by a base that is operatively associated with the core of the cylinder unit, an elongate body portion that is positioned above the base and has end portions designed to be seated in corresponding recesses of the rod and a stop portion that projects laterally from the elongate body portion.

Rotating the core of the cylinder unit to open the padlock causes the rotation of the base opens the base of the actuating device and consequently the rotation of the elongate body causing the end portions of the elongate body to come out of the recesses in the rod. The rotation of the actuating device to open the padlock is limited by a limiting surface of the body, and when the actuator is rotated to open the padlock, the stop portion of the actuating device cooperates with a cut-out portion of the rod to prevent the complete removal of the rod from the body.

Preferably, the stop portion projects laterally from one end of the elongated body portion.

The padlock body is formed by a box and a cover, and the limiting surface is formed by a surface of the cover.

Preferably, the positioning of the components is guaranteed by positioners on the closing surface of the box and by cavities for the positioners on the closing surface of the cover."

Preferably, the stop portion is a "parrot's beak" shaped portion, in which a tip furthest from the "parrot's beak" shaped portion interacts with the cut-out portion of the rod when the rotation of the actuating device is limited by the surfaces of the box and padlock cover.

The box, cover and actuating device can be made of thermosetting polymer "anti-flame", so as not to conduct electricity and do not spread flames, the cover and the box being joined by the ultrasonic welding process, after the actuating device, cylinder unit and rod have been positioned in the padlock box and the assembly has been completed with the closure with the cover.

The actuating device and the rod can be injected in resin, and the cylinder unit is made of Zamac alloy, brass and steel.

BRIEF DESCRIPTION OF THE DRAWINGS

The present invention will be described in more detail below, with reference to the accompanying drawings, in which.

DETAILED DESCRIPTION OF THE INVENTION

The present invention will be described below based on a preferred embodiment shown in FIGS. 1 to 8.

Figure 1:
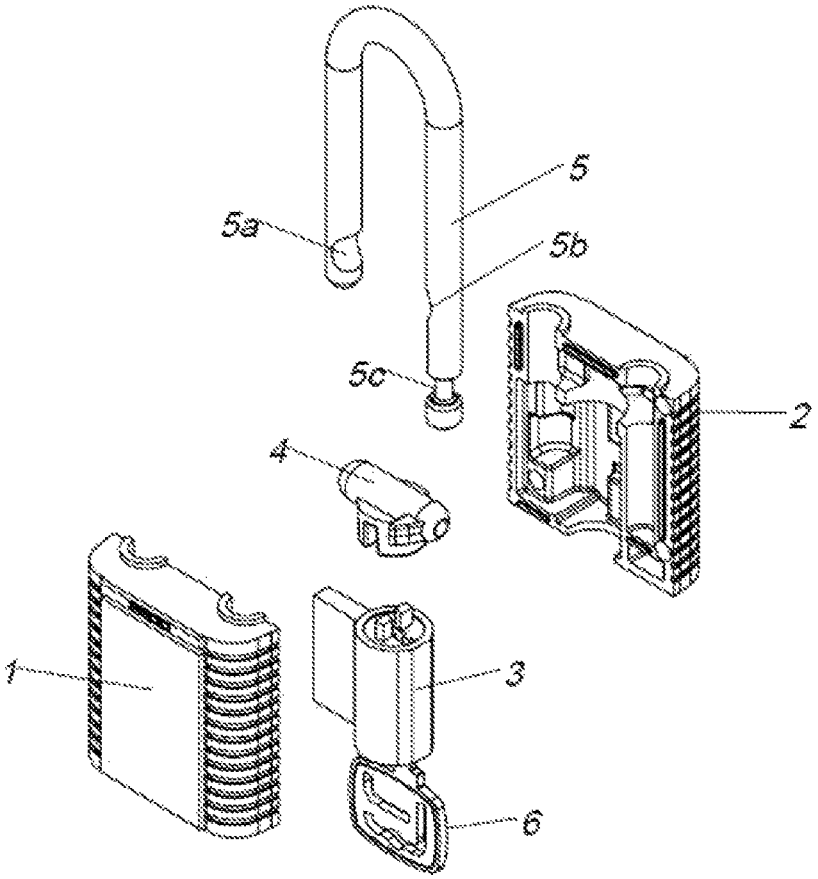
FIG. 1—is an exploded perspective view of a padlock according to a preferred embodiment of the present invention.

FIG. 1 shows an exploded view of a padlock according to a preferred embodiment of the present invention.

The padlock comprises a body formed by a cover 1 and a box 2.

The cover 1 and a box 2 are preferably made of polymeric material, preferably in Acrylonitrile Butadiene Styrene (ABS) with pigmentation additives and flame retardants, and are configured to receive the cylinder unit 3, a actuanting device 4 and a U-shaped rod 5.

The cylinder unit 3 is a part whose operation is widely known to those skilled in the art and generally comprises a housing that houses a core that receives the key. When the correct key is inserted into the core and rotated, the core is also rotated. The operation of this type of cylinder unit is well known in the art and therefore will not be described in detail here.

In the preferred embodiment of the present invention, the cylinder unit is composed of Zamak alloy, brass and steel components and whose pin configuration allows 3125 combinations.

In one embodiment of the invention, the housing of the cylinder unit 3 of the present invention is designed so that the pin housing portion has an axial length less than the length of the core housing portion and a slightly tapered cross section from the core housing portion for the opposite direction.

Figure 2:
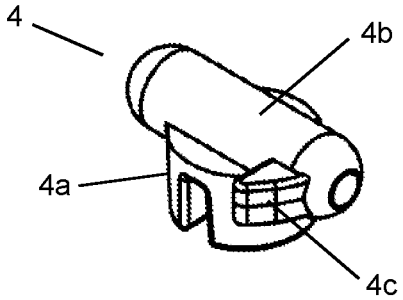
FIG. 2—is a perspective view of the actuanting device of a padlock according to a preferred embodiment of the present invention.
Figure 3:
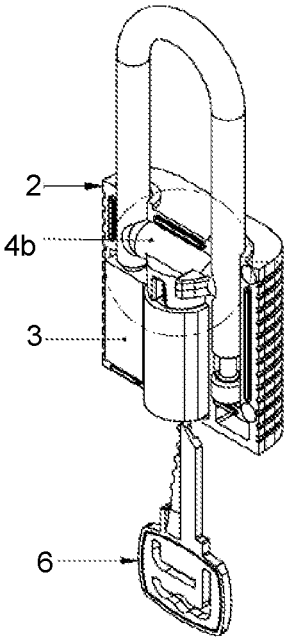
FIG. 3—is a perspective view of the padlock according to a preferred embodiment of the present invention in closed configuration, the padlock being illustrated without the cover.
Figure 3A:
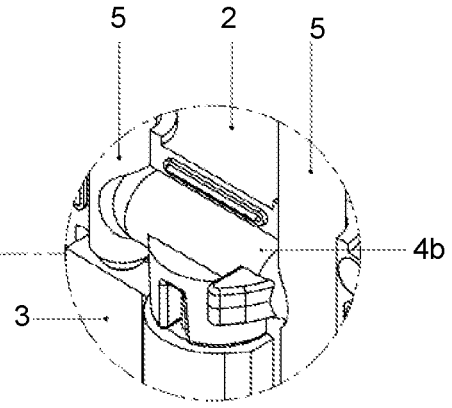
FIG. 3*a*—is a detail view of FIG. 3 showing the actuanting device and the rod in the "closed" position.

As best seen in FIG. 2, in the technical solution proposed by the present invention, the cylinder is operatively associated with a one-piece actuating device 4, so that the rotation of the core of the cylinder leads to the rotation of the actuating device 4. The term "operatively associated" includes, for example, a fit between the base of the actuating device and the upper part of the core of the cylinder.

Preferably, the actuating device 4 is a single piece injected in resin. In the preferred embodiment of the invention, the resin is a XENOYTM 5220U BK 1066 resin (Polycarbonate (PC)+Polybutylene Terafilate (PBT)+ethylene polyetheraphylate (PT)

The actuating device 4 comprises a base 4*a* that cooperates with the core of the cylinder unit, an elongated body portion 4*b* that is positioned above the base 4*a*, and a stop portion 4*c* that protrudes laterally from the elongated body portion 4*b*.

The U-shaped rod 5 is preferably injected with resin and has a longer leg than the other. The rod has two opposite recesses 5*a* and 5*b*, and the longest leg of the rod has a cut-out portion of the rod 5*c*.

In one embodiment of the invention, the U-shaped rod is made of steel. However, preferably, the rod is injected in XENOYTM 5220U BK 1066 resin.

The elongated body portion 4*b* of the actuating device 4 has two ends that project longitudinally beyond the base 4*a*, the most extreme portion of each end having a semi-spherical shape.

The most extreme portions are received by the recesses 5*a* and 5*b* when the padlock is closed.

FIGS. 3 and 3*a* and 4 and 4*a* show the padlock in closed configuration, the padlock being shown without the cover 1.

In this configuration, in which the key 6 can be removed from the cylinder unit 3, the most extreme portions of the elongated body 4*b* of the actuanting device 4 are seated in the recesses 5*a* and 5*b* of the rod 5.

Figure 4:
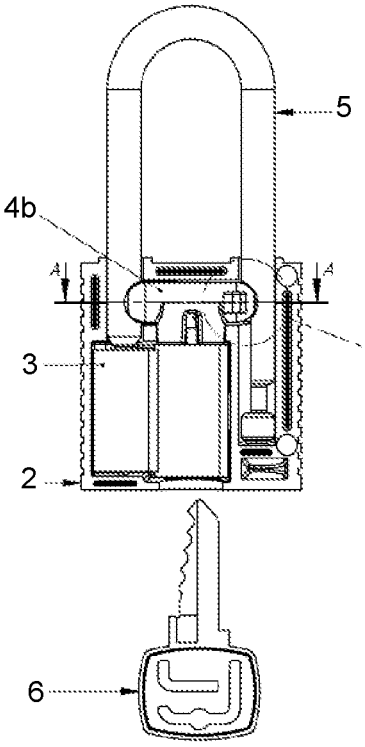
FIG. 4—is a front view of the padlock according to a preferred embodiment of the present invention in closed configuration, the padlock being illustrated without the padlock cover.
Figure 4A:
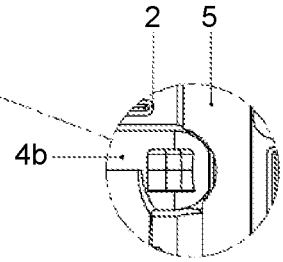
FIG. 4*a*—is a detail view of FIG. 4 showing the actuanting device and the rod in the "closed" position"
Figure 4B:
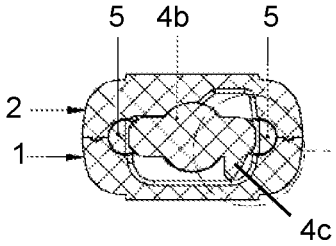
FIG. 4*b*—is a view of section A-A in FIG. 4.
Figure 4C:
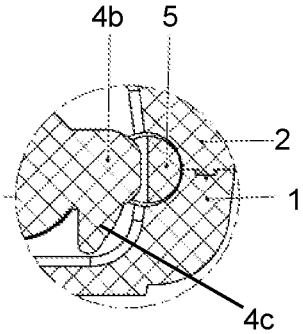
FIG. 4*c*—is a detail view of FIG. 4*b;*

As best seen in sectional FIGS. 4*b* and 4*c*, in this configuration with the padlock closed, the stop portion 4*c* does not interact with any part of the rod or body of the padlock.

Figure 5:
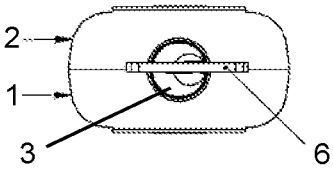
FIG. 5—is a bottom view of the padlock according to a preferred embodiment of the present invention in closed configuration.
Figure 6:
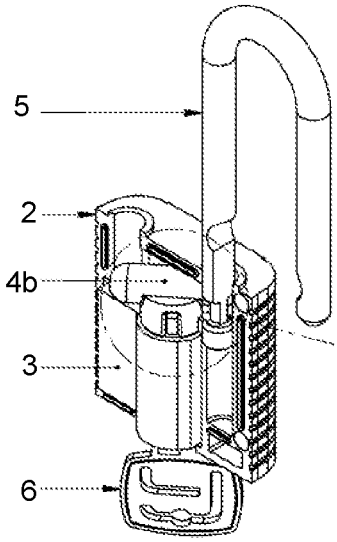
FIG. 6—is a perspective view of the padlock according to a preferred embodiment of the present invention in an open configuration, the padlock being illustrated without the padlock cover.
Figure 6A:
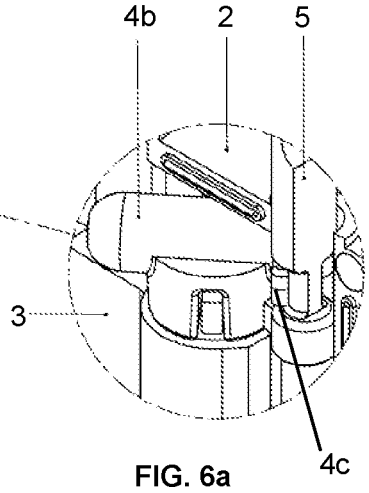
FIG. 6*a*—is a detail view of FIG. 6 showing the actuating device and the rod in the "open" position where the limiter of the actuator is preventing the complete removal of the rod, allowing only the rotation of the rod.

In addition, as shown in the bottom view of FIG. 5, when the padlock is closed, key 6 can be inserted and removed from the core of the cylinder unit 3 in a horizontal position, wherein there is no key limiter in the geometry of the cover and housing 1 and 2.

FIGS. 6 and 6*a* and 7 and 7*a* show the padlock in open configuration, the padlock being shown without the cover 1.

To open the lock, the user, after inserting key 6 in the core 3 of the cylinder unit, when the padlock is closed, turns key 6, causing the rotation of the core of the unit 3.

Since the base 4*a* of the actuanting device 4 is operatively associated with the corte of the cylinder unit 3, the actuating device is rotated, causing the most extreme portions of the elongated body 4*b* to come out of the recesses 5*a* and 5*b*, allowing the movement of the rod 5.

Figure 7:
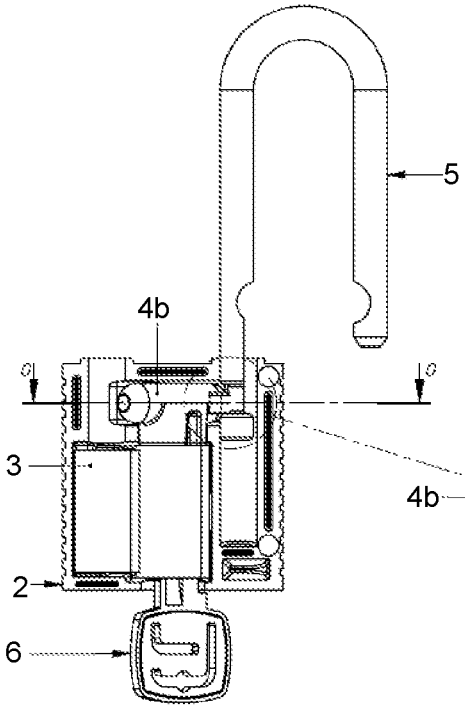
FIG. 7—is a front view of the padlock according to a preferred embodiment of the present invention in an open configuration, the padlock being illustrated without the padlock cover.
Figure 7A:
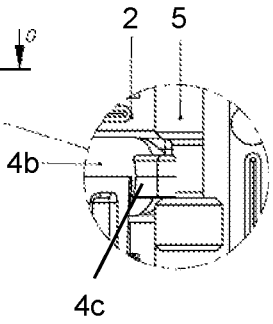
FIG. 7*a*—is a detail view of FIG. 7 showing the actuator and the rod in the "open" position where the limiter is preventing the complete removal of the rod, allowing only the rotation of the rod.
Figure 7B:
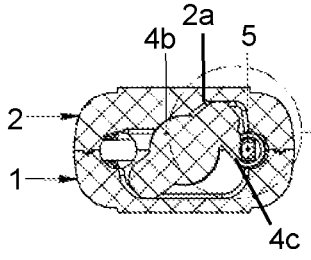
FIG. 7*b*—is a view of the O-O section of FIG. 7.
Figure 7C:
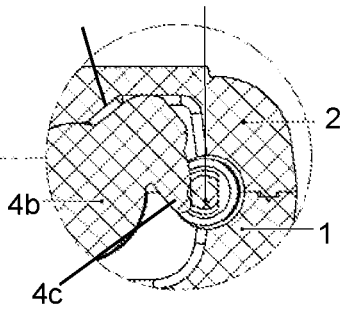
FIG. 7*c*—is a detail view of FIG. 7*b*.
Figure 8:
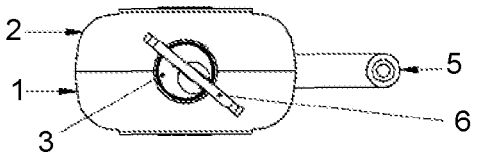
FIG. 8—a bottom view of the padlock according to a preferred embodiment of the present invention in open configuration.

As best seen in section FIG. 7*b* and in detail view of FIG. 7*c*, the rotation of the actuating device 4 is limited by the box 2, the box 2 having an internal surface portion 2*a* configured to limit the rotating movement of the actuating device.

As mentioned earlier, the actuating device 4 has a stop portion 4*c* that extends laterally from one end of the elongated body 4*c*. Obviously, that stop portion 4*c* rotates following the rotation of the actuating device.

The stop portion 4*c* is configured to cooperate with the cutout portion 5*c* of the rod 5 and thereby prevent the complete removal of the rod 5 from the elongated body.

As best seen in the figures in the sectional FIG. 7*b* and in the detail view of FIG. 7*c*, when the device 4 is rotated until part of its body touches the limiting surface 2*a* of the box 2, the stop portion 4*c* projects towards the rod 5 and seats in the cut-out portion 5*c* of the rod.

Preferably, the stop portion 4*c* has a "parrot's beak" shape, so as to allow the rotation of the rod around the axial axis of the longest leg, until the tip furthest from the beak acts as the limiter when the rotation of the device 4 is limited by the surface 2*a* of the box 2.

Thus, the limiter contained in the actuator acts as limiter of the rod, preventing it from being removed entirely, allowing it to just rotate.

It should be noted that while the core of the cylinder unit 3 is in a rotated position—that is, while the device 4 is in a rotated position—the key 6 cannot be removed from the cylinder, preventing the user from forgetting the pdlock in open configuration. This is due to the fact that the secret pins are rotated inside the core, fitted to the key. The key can only be removed if the pins are accessible with the secret holes contained in the cylinder body, so that they release the key by going back to these holes.

Thus, the padlock of the present invention has an extremely simplified construction where the one-piece actuating device 4 acts as a rotary actuator, rod locking means and rod retaining means.

The reduction in the number of parts, in addition to simplifying and cheapening the production process, decreases the risk of possible failures in the interactions of the parts.

For the assembly of the padlock according to the present invention, the actuator 4 is fitted in the cylinder unit 3 then both are fitted in the padlock box 2, as well as the rod 5, then the padlock cover 1 is positioned, so that cover 1 and box 2 are joined by the ultrasonic welding process.

The fact that an example of a preferred embodiment of the present invention has been described here, it should be understood that the scope of the present invention encompasses other possible variations of the inventive concept described, being limited only by the content of the claims, including the possible equivalents therein.

The invention claimed is:

1. A padlock of the type comprising a U-shaped rod (5) seated in a body, the rod (5) being unlocked by rotation of a core of a cylinder unit (3), characterized by the fact that it also comprises:

a one-piece actuating device (4) comprising a base (4*a*) that is operatively associated with the core of the cylinder unit, an elongated body portion (4*b*) that is positioned above the base (4*a*) and has extreme portions configured for to be accommodated in corresponding rod recesses (5), and a stop portion (4*c*) projecting laterally from the elongated body portion (4*b*);

wherein the rotation of the core of the cylinder unit (3) to open the lock causes the rotation of the base (4*a*) of the actuating device (4) and consequently the rotation of the elongated body (4*b*), causing the extreme portions of the elongated body (4*b*) to come out of the recesses in the rod (5), and wherein the rotation of the actuating device (4) for opening the padlock is limited by a limiting surface (2*a*) on the body and where the stop portion (4*c*) of the actuating device (4) cooperates with a cut-out portion (5*c*) of the rod (5) to prevent complete removal of the rod (5) from the body.

2. The padlock according to claim 1, characterized in that the stop portion (4*c*) protrudes laterally from one end of the elongated body portion (4*b*).

3. The padlock, according to claim 2, characterized by the fact that the body of the padlock is formed by a cover (1) and a box (2), in which the limiting surface (2*a*) is formed by a surface of the box (2).

4. The padlock, according to claim 3, characterized by the fact that the stop portion (4*c*) is a "parrot's beak" shaped portion, in which an end furthest from the "parrot's beak" shaped portion interacts with the cut-out portion (5*c*) when the rotation of the actuating device (4) is limited by the surface (2*a*) of the box (2).

5. The padlock, according to claim 4, characterized by the fact that the cover (1) and the box (2) are made of polymeric material, the box and the cover being welded together by ultrasound.

6. The padlock, according to claim 5, characterized by the fact that the actuating device (4) and the rod (5) are injected in resin.

7. The padlock, according to claim 6, characterized by the fact that the cylinder unit (3) is made of Zamak alloy.

* * * * *